US008714547B2

(12) United States Patent
Uchiyama et al.

(10) Patent No.: US 8,714,547 B2
(45) Date of Patent: May 6, 2014

(54) PAPER DISCHARGE APPARATUS AND IMAGE FORMING APPARATUS EQUIPPED WITH PAPER DISCHARGE APPARATUS

(75) Inventors: Masaaki Uchiyama, Sagamihara (JP); Hiroyuki Wakabayashi, Hachioji (JP); Tsutomu Anezaki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 200 days.

(21) Appl. No.: 12/944,098

(22) Filed: Nov. 11, 2010

(65) Prior Publication Data

US 2011/0115153 A1 May 19, 2011

(30) Foreign Application Priority Data

Nov. 17, 2009 (JP) ..... 2009-261609

(51) Int. Cl.
*B65H 31/20* (2006.01)

(52) U.S. Cl.
USPC ..... 271/224; 271/220; 271/221; 271/209; 270/58.11; 270/58.12; 270/58.17; 270/58.27

(58) Field of Classification Search
USPC ..... 271/207, 220, 221, 224; 270/58.11, 270/58.12, 58.17, 58.27
See application file for complete search history.

(56) References Cited

U.S. PATENT DOCUMENTS 5,058,880 A * 10/1991 McGraw et al. ..... 271/315
5,409,202 A * 4/1995 Naramore et al. ..... 270/58.12
5,480,130 A * 1/1996 Suzuki et al. ..... 270/58.11
5,609,333 A * 3/1997 Mandel et al. ..... 270/58.09
6,120,020 A 9/2000 Asao
6,398,203 B1 * 6/2002 Saito et al. ..... 270/58.12
6,527,269 B2 * 3/2003 Yamada et al. ..... 271/221
7,007,948 B2 * 3/2006 Kamiya et al. ..... 271/221
7,198,261 B2 * 4/2007 Matsumoto et al. ..... 270/58.09
8,172,214 B2 * 5/2012 Kubota et al. ..... 270/58.1

(Continued)

FOREIGN PATENT DOCUMENTS

JP 01261161 A * 10/1989 ..... B65H 29/22
JP 10-279169 A 10/1998
JP 2008-273656 A 11/2008

OTHER PUBLICATIONS

Japanese Office Action dated Aug. 21, 2013 (and English translation thereof) in counterpart Japanese Application No. 2009-261609.

*Primary Examiner* — Prasad Gokhale
(74) *Attorney, Agent, or Firm* — Holtz, Holtz, Goodman & Chick, PC

(57) ABSTRACT

A paper discharge apparatus including, a paper loading portion for loading a paper which is discharged; a paper rear-end abutting portion which a rear end of paper in a paper conveying direction abuts; a pair of paper holding members for holding the paper at the paper holding position when the paper is discharged; a paper holding member moving device which is connected to at least one of the pair of the paper holding members and moves the pair of the paper holding members from a paper holding position to a paper loading position; when the pair of the paper holding members reach the paper loading position, the paper holding member moving device moves at least one of the pair of the paper holding members in the opposite direction of the paper conveying direction and makes the rear end of the holding paper abut the paper rear-end abutting portion.

8 Claims, 6 Drawing Sheets

(56) References Cited

U.S. PATENT DOCUMENTS 8,376,355 B2 * 2/2013 Sugitani et al. ..... 271/176
2007/0108698 A1 * 5/2007 Tamura et al. ..... 271/220
2010/0150636 A1 * 6/2010 Kubota et al. ..... 399/407
2010/0283198 A1 * 11/2010 Saito et al. ..... 271/221

* cited by examiner

PAPER DISCHARGE APPARATUS AND IMAGE FORMING APPARATUS EQUIPPED WITH PAPER DISCHARGE APPARATUS

RELATED APPLICATION

The present application is based on Patent Application No. 2009-261609 filed at the Japan Patent Office on Nov. 17, 2009 and which is hereby incorporated herein in its entirety.

TECHNICAL FIELD

The present invention relates to a paper discharge apparatus for loading paper discharged from a discharge device onto a paper loading table and an image forming apparatus equipped with the paper discharge apparatus.

BACKGROUND

An image forming apparatus, such as a printer, copier, and the like, and post-processing device thereof are mostly equipped with a paper loading table for temporarily storing plural sheets of paper having images formed thereon within the apparatus and also equipped with a paper discharge tray located outside the apparatus and loaded with the discharged paper. When paper is discharged onto the paper loading table or the paper discharge tray (hereinafter, collectively referred to as a paper loading table), there is a problem in that the paper loading position is deviated during the period after a sheet of paper left the paper conveyance roller (hereinafter, referred to as a discharge roller) located immediately before the paper loading table and before the sheet of paper drops by its own weight onto the paper loading table; consequently, the paper is not loaded on the paper loading table in the aligned state. This problem tends to arise regardless of whether the paper loading table is horizontally disposed or the paper loading table is disposed with the loading surface thereof inclined. Particularly, this problem tends to arise when the paper conveyance speed is high or environmental conditions are severe (high-temperature and high-humidity condition, or low-temperature and low-humidity condition). Furthermore, it is comparatively easy to align a sheet of paper by an alignment device for aligning paper in the direction (paper width direction) perpendicular to the paper conveying direction when the sheet of paper is discharged. However, it is difficult to align the sheet of paper in the paper conveying direction. In order to improve the paper alignment condition in the paper conveying direction on the paper loading table, a variety of paper discharge apparatus have been developed. However, there are problems in that the mechanism is complicated and the device becomes too large, or the sheets of paper are not loaded in the aligned state.

To address the above problems, there is disclosed a technology wherein the rear end of discharged paper is held by a gripper, and the gripper is moved, thereby loading the paper onto the paper discharge tray (for example, see Japanese Patent Application Publication: No. 2008-273656). The technology described in Japanese Patent Application Publication: No. 2008-273656 is also advantageous because the technology can apply to stapled paper and shift-processed paper.

SUMMARY

However, even in the technology described in Japanese Patent Application Publication: No. 2008-273656, it is difficult to neatly align the rear end of paper. Also, when the discharged paper is received by the gripper, the discharged paper must temporarily stop. Thus, there is also a problem in that it takes extra time until the paper is loaded onto the paper loading table.

One aspects of the present invention are any one of the bookbinding apparatus or the image forming system described as follows.

1. A paper discharge apparatus including, a paper loading device having a paper loading portion for loading paper discharged from the discharge device, and a paper rear-end abutting portion which the rear end of paper in the paper conveying direction abuts when the paper is discharged from the discharge device; and, a paper holding member for holding paper discharged from the discharge device at a paper holding position and moving the paper to a paper loading position of the paper loading portion; wherein the paper holding member composed of a pair of paper holding members for holding paper at the paper holding position; the paper discharge apparatus has a paper holding member moving device which is connected to at least one of the pair of the paper holding members and moves the pair of the paper holding members from the paper holding position to the paper loading position, and, moves and holds paper by the pair of the paper holding members during the paper has been discharged from the discharge device and the paper is loaded onto the paper loading portion; and when the pair of the paper holding members reach the paper loading position, the paper holding member moving device moves at least one of the pair of the paper holding members in the opposite direction of the paper conveying direction and makes the rear end of the holding paper abut the paper rear-end abutting portion.

2. Another aspect of the present invention is an image forming apparatus having a paper discharge apparatus of claim 1.

DESCRIPTION OF THE PREFERRED EMBODIMENTS

The present invention will be described based on the illustrated embodiments, however, the present invention is not intended to be limited to those embodiments.

First, an explanation will be given about an image forming apparatus equipped with a paper discharge apparatus according to the present invention with reference to the drawings.

(Image Forming System A)

Figure 1:
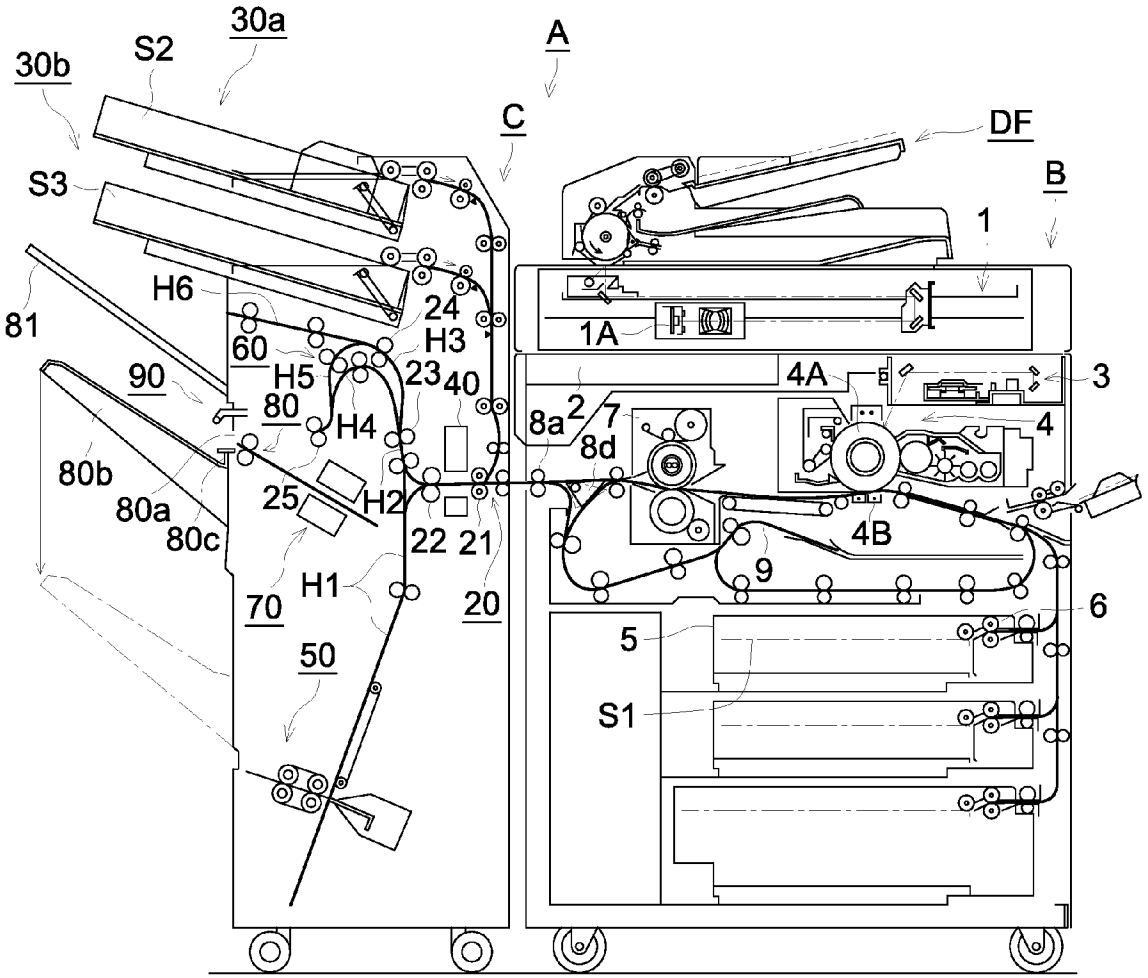
FIG. 1 is an overall view showing an embodiment of an image forming system A according to the present invention composed of an image forming apparatus main body B and a post-processing device C.

FIG. 1 is an overall view showing an embodiment of an image forming system A according to the present invention composed of an image forming apparatus main body B and a post-processing device C. In the present invention, either an image forming apparatus main body B alone or an entire image forming system A wherein a post-processing device C is coupled to the image forming apparatus main body B is referred to as an image forming apparatus. The paper discharge apparatus according to the present invention can apply to both the image forming apparatus main body B and the post-processing device C.

(Image Forming Apparatus Main Body B in the Image Forming System A)

The image forming apparatus main body B shown in FIG. 1 is equipped with an image reading portion 1, an image processing portion 2, an image writing portion 3, an image forming portion 4, a paper feeding cassette 5, a paper feeding device 6, a fixing device 7, a paper discharge mechanism portion 8, and an automatic double-sided copying paper feeding portion (ADU) 9.

An automatic document feeder DF is disposed on the upper side of the image forming apparatus main body B. The post-processing device C is coupled to the paper discharge mechanism portion 8 side located on the left side-face of the image forming apparatus main body B as shown in the drawing.

A manuscript placed on the manuscript table of the automatic document feeder DF is carried in the direction of the arrow, either a single-sided image or double-sided images of the manuscript are read by the optical system of the image reading portion 1 and then read into the CCD image sensor 1A.

An analog signal is photoelectrically converted by the CCD image sensor 1A, subsequently, the analog processing, A/D conversion, shading correction, and the image compression are executed in the image processing portion 2, and then the image or images are sent to the image writing portion 3.

When an image is formed, light is emitted from the semiconductor laser of the image writing portion 3 onto the photoreceptor drum 4*a* of the image forming portion 4, thereby forming a latent image. In the image forming portion 4, electrical charging, exposure, development, transcription, separation, cleaning, and the like are executed. Paper S1 fed from the paper feeding cassette 5 by the paper feeding device 6 abuts the photoreceptor drum 4*a* wherein a latent image has been converted into a toner image by the development process, and the toner image is transcribed by the transcription device 4*b*. The paper S1 carrying the toner image is fixed by the fixing device 7 and then sent to the post-processing device C via the paper discharge roller 8*a* functioning as a discharge device. When double-side copying is executed, paper S1 on which a single-sided image has been processed is sent to the automatic double-sided copying paper feeding portion 9 by the conveyance pathway switch board 8*d*, and another image is then processed on the back side of the paper in the image forming portion 4, fixed, and then the paper is discharged by the paper discharge roller 8*a*.

Next, an embodiment of the post-processing device C equipped with the paper discharge apparatus according to the present invention will be described with reference to FIG. 1.

(Post-Processing Device C)

A post-processing device C is equipped with a paper skew correcting mechanism portion 20, insertion paper feeding portions 30*a* and 30*b*, and a plurality of post-processing mechanism portions, such as a punching mechanism portion 40, a folding mechanism portion 50, an overlapping mechanism portion 60, a binding mechanism portion 70, a paper discharge mechanism portion 80, and a paper discharge apparatus 90.

Insertion paper S2 is loaded into the insertion paper feeding portion 30*a*, and another insertion paper S3 is loaded into the insertion paper feeding portion 30*b*. Insertion paper S2 and S3 is a cover paper, insertion paper, and the like, which is inserted into paper S1 discharged from the image forming apparatus main body B, and can be punched and folded in the same manner as paper S1. Insertion paper S2 and S3 sent from the insertion paper feeding portions 30*a* and 30*b* is carried downward via a conveyance pathway (no reference code assigned) to the paper skew correcting mechanism portion 20.

The paper skew correcting mechanism portion 20 is disposed facing the paper discharge mechanism portion 8 of the image forming apparatus main body B. Paper S1 discharged from the paper discharge mechanism portion 8 of the image forming apparatus main body B and insertion paper S2 and S3 sent from the insertion paper feeding portions 30*a* and 30*b* are first carried into the paper skew correcting mechanism portion 20.

The punching mechanism portion 40 is disposed downstream of the paper skew correcting mechanism portion 20 in the paper conveying direction, and a conveyance roller 22 is disposed downstream of the punching mechanism portion 40.

The folding mechanism portion 50 is disposed on the conveyance pathway H1 branching downward from the conveyance roller 22.

The overlapping mechanism portion 60 is disposed downstream of conveyance pathway H2 branching upward from the conveyance roller 22 and is equipped with conveyance pathways H3, H4, and H5. The overlapping mechanism portion 60 is intended to be provided so that the succeeding sheets of paper can stand by on the conveyance pathways H3, H4, and H5 in order to ensure time to bind the preceding sheets of paper in the binding mechanism portion 70 located downstream.

The conveyance pathway located downstream of the conveyance roller 23 splits from the conveyance roller 23 into doubly curved conveyance pathways: the inner-side conveyance pathway H4 and the outer-side conveyance pathways H3 and H5. The conveyance pathway H4 branching from the conveyance roller 23 and forming a curved inner-side conveyance pathway is connected to the temporary stop roller 25, and the first sheet of paper to be bound will stand by on the conveyance pathway H4 in the condition where the front edge of the sheet abuts the temporary stop roller 25 that has stopped rotating.

The conveyance pathway H3 forming a curved outer-side conveyance pathway together with the conveyance pathway H5 reaches the conveyance roller 24 at a location downstream of the conveyance roller 23, where the conveyance pathway H3 branches into conveyance pathway H5 and conveyance pathway H6. The conveyance pathway H5 forms curved outer-side conveyance pathways H3 and H5 together with the conveyance pathway H3 and extends toward the temporary stop roller 25. The conveyance pathway H6 branches from the outer-side conveyance pathway H3 and extends toward the fixed paper discharge tray 81. While the first sheet of paper to be bound stands by on the inner-side conveyance pathway H4, a preceding sheet of paper is bound in the binding mechanism portion 70, and the second sheet of paper is carried on the outer-side conveyance pathways H3 and H5. After that, the first and second sheets of paper are overlapped and carried to the binding mechanism portion 70 in the overlapping manner.

The fixed paper discharge tray 81 is disposed at a location downstream of the conveyance pathway H6 branching from the overlapping mechanism portion 60 at the conveyance roller 24 on the conveyance pathway H3, and the fixed paper discharge tray 81 protrudes from the post-processing device C. The fixed paper discharge tray 81 is the tray onto which paper S1 or insertion paper S2 and S3 (hereinafter, collectively and simply referred to as paper) requiring no post-processing is discharged. For typical examples, paper is discharged onto the fixed paper discharge tray 81 in the small-quantity copy mode, trial copy mode, and in cases when a paper jam has occurred and the paper jammed in the machine needs to be removed.

The conveyance pathway extending from the conveyance roller 24 to the conveyance pathway H5 is connected to the temporary stop roller 25.

A binding mechanism portion 70 is disposed downward and downstream of the temporary stop roller 25, and a paper discharge mechanism portion 80 and a paper discharge apparatus 90 are disposed protruding from the post-processing device C at locations downstream of the temporary stop roller 25 and the binding mechanism portion 70.

The binding mechanism portion 70 binds paper S1, S2, and S3 carried from the temporary stop roller 25. The bound paper S1, S2, and S3 is carried to the paper discharge mechanism portion 80.

The paper discharge mechanism portion 80 is equipped with a paper discharge roller 80*a* functioning as a discharge device, an up-and-down paper discharge tray 80*b* functioning as a paper loading device, and a paper rear-end abutting portion 80*c*. The up-and-down paper discharge tray 80*b* is a paper discharge mechanism portion referred to as a main tray, which is a large-capacity tray that can contain approximately 3000 sheets of paper. Paper is discharged onto the up-and-down paper discharge tray 80*b* in the large-quantity copy mode, printing mode based on the printing instruction made by external devices, binding mode, and the shift-processing mode. The paper discharge roller 80*a* is driven by a paper discharge drive motor M1, not shown, and ejects paper S1, S2, and S3 discharged from the post-processing device C onto the up-and-down paper discharge tray 80*b*.

The paper discharge apparatus 90 according to the present invention is disposed at a location near the paper discharge mechanism portion 80 and loads the paper S1, S2, and S3 discharged by the paper discharge roller 80*a* onto the up-and-down paper discharge tray 80*b* in the aligned state.

Next, operation of paper S1, S2, and S3 will be described according to the conveyance pathways.

In the paper skew correcting mechanism portion 20, whether to correct the skew of the paper S1 discharged from the image forming apparatus main body B and the insertion paper S2 and S3 fed from the insertion paper feeding portions 30*a* and 30*b* is determined according to the mechanism portion that has been selected as post-processing from a plurality of post-processing mechanism portions. This determination will determine the operation of the resist roller 21 and the conveyance rollers 18 and 19, and then skew of the paper is corrected as necessary.

The paper S1, S2, and S3 (hereinafter, also representatively referred to as S1) carried via the paper skew correcting mechanism portion 20 is carried on the conveyance pathway where the punching mechanism portion 40 is disposed, the paper is punched as necessary, and then carried to the conveyance roller 22.

When paper S1 reaches the conveyance roller 22, the paper is carried on a different conveyance pathway according to whether the paper is to be folded or not as post-processing. When the paper is to be folded, the paper is caned downward to the conveyance pathway H1, and when the paper is not to be folded, the paper is carried upward to the conveyance pathway H2. The conveyance pathways are switched by a known mechanism, such as a switch lever, or the like.

When paper S1 is to be folded, the paper S1 is carried downward via the conveyance pathway H1 and reaches the folding mechanism portion 50. The paper S1 that has been folded in the folding mechanism portion 50 passes through the conveyance pathway, not shown, and is discharged onto the discharge tray, not shown.

When paper S1 is not to be folded, paper S1 is carried upward via the conveyance pathway H2 and reaches the conveyance roller 23.

When post-processing is not scheduled for the first sheet of the paper S1 that has reached the conveyance roller 23, the sheet is carried through the conveyance pathway H3, passing the conveyance roller 24, to the conveyance pathway H6, and then discharged onto the fixed paper discharge tray 81.

When binding is not executed and all sheets of paper including the first sheet are discharged onto the up-and-down paper discharge tray 80*b* of the paper discharge mechanism portion 80, paper S1 is carried from the conveyance roller 23 via the conveyance pathway H4 to the paper discharge mechanism portion 80. Paper S1 to be discharged onto the up-and-down paper discharge tray 80*b* of the paper discharge mechanism portion 80 is loaded onto the up-and-down paper discharge tray 80*b* in the condition in which the rear end of the paper has been aligned by the paper discharge apparatus 90.

When paper is to be overlapped and bound, the first sheet of paper is carried via the conveyance pathway H4 and the front edge of the paper abuts the temporary stop roller 25 and stops, and then is on stand-by until the second sheet of paper arrives.

The second sheet of paper is carried from the conveyance roller 23, passing through conveyance pathway H3, conveyance roller 24, conveyance pathway H5, and stops at the location where the front edge of the paper abuts the temporary stop roller 25, and then the front edges of the first and second sheets of paper are aligned. After that, the first and second sheets of paper are sent to the binding mechanism portion 70 in the overlapped condition. In the same manner as the first sheet of paper, the third sheet of paper passes through the conveyance pathway H4, stops at the temporary stop roller 25; and in the same manner as the second sheet of paper, the fourth sheet of paper passes through the conveyance pathways H3 and H5, stops at the temporary stop roller 25, and then the third and fourth sheets are sent as a set to the binding mechanism portion 70. Hereinafter, the fifth sheet and the following sheets of paper are also processed in the same manner, the predetermined number of sheets are processed, and those sheets of paper are bound. The bunch of bound paper is loaded onto the up-and-down paper discharge tray 80*b* via the paper discharge apparatus 90.

(Image Forming Apparatus Main Body B as a Single Body)

Figure 2:
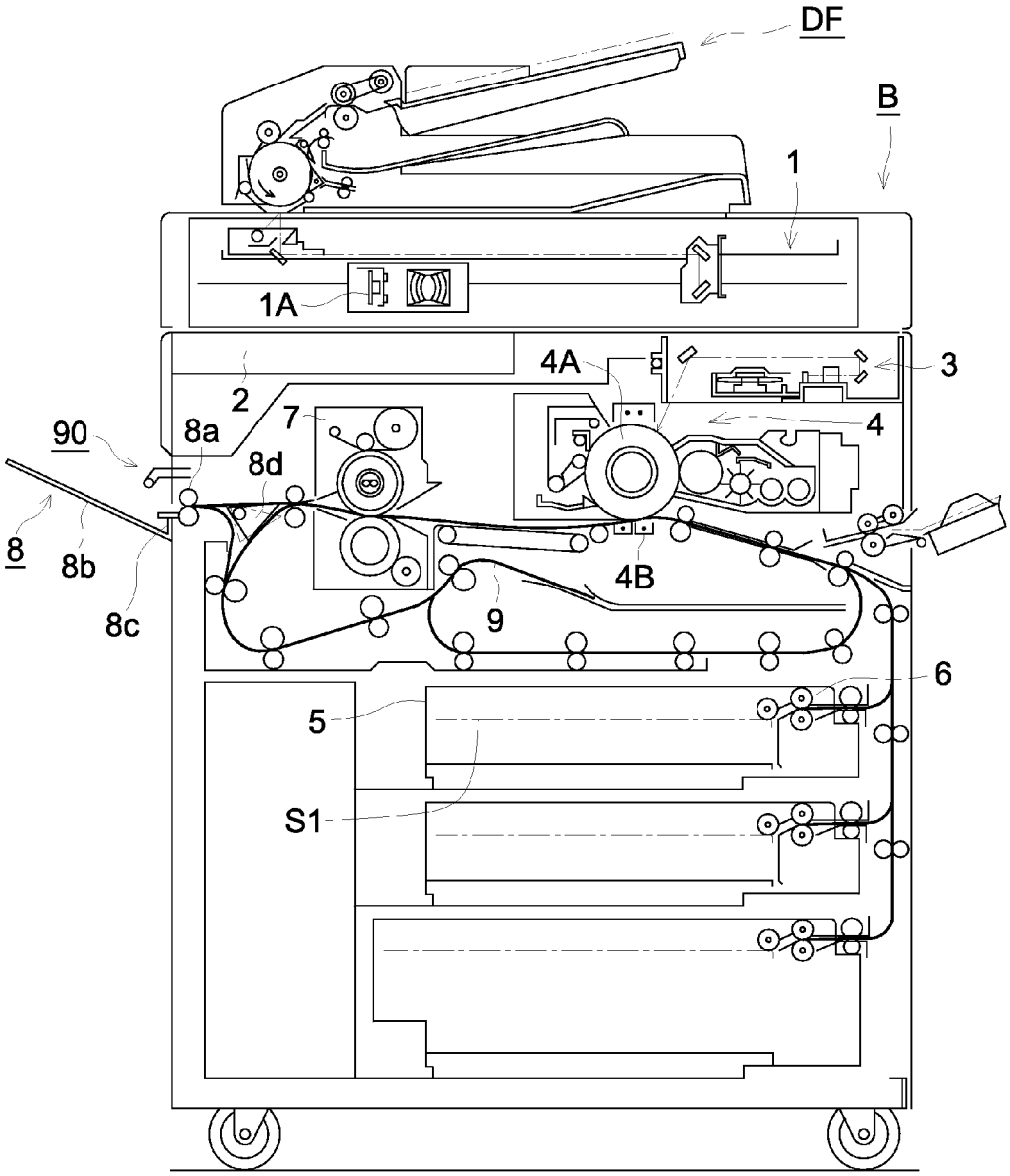
FIG. 2 is an overall view showing an embodiment of an image forming apparatus main body B according to the present invention as a single body.

FIG. 2 is an overall view showing an embodiment of an image forming apparatus main body B according to the present invention as a single body. Because the image forming apparatus main body B as a single body is similar to the image forming apparatus main body B included in the image forming system A, the same number and symbol are assigned to the member having the same function, therefore, descriptions will be omitted and only different parts of the configuration will be described.

The difference between the image forming apparatus main body B shown in FIG. 2 and the image forming apparatus main body B shown in FIG. 1 is the configuration located downstream of the paper discharge roller 8*a* in the paper conveying direction. That is, the post-processing device C is disposed downstream of the paper discharge roller 8*a* in the image forming apparatus main body B shown in FIG. 1, while the paper discharge mechanism portion 8 and the paper discharge apparatus 90 are disposed in the image forming apparatus main body B shown in FIG. 2.

The paper discharge mechanism portion 8 is equipped with a paper discharge roller 8*a*, a paper discharge tray 8*b* functioning as a paper loading device, and a paper rear-end abutting portion 8*c*. Paper S1 discharged from the paper discharge roller 8*a* is ejected and loaded onto the paper discharge tray 8*b* in the condition in which the rear end of the paper abuts the paper rear-end abutting portion 8*c*. The paper discharge roller 8*a* is driven by a paper discharge drive motor M1, not shown. The paper discharge apparatus 90 according to the present invention will hereinafter be described.

Moreover, the paper discharge tray 8*b* is a fixed type in this embodiment; however, it is obvious that the paper discharge tray 8*b* may be an up-and-down type in the same manner as the up-and-down paper discharge tray 80*b* of the paper discharge mechanism portion 80 shown in FIG. 1.

Furthermore, in the same manner as the image forming apparatus main body B of the image forming system A, the present invention can also apply to the configuration wherein the paper discharge mechanism portion 8 is equipped with an alignment device for aligning paper in the direction (paper width direction) perpendicular to the paper conveying direction.

(Paper Discharge Apparatus 90)

Figure 3A:
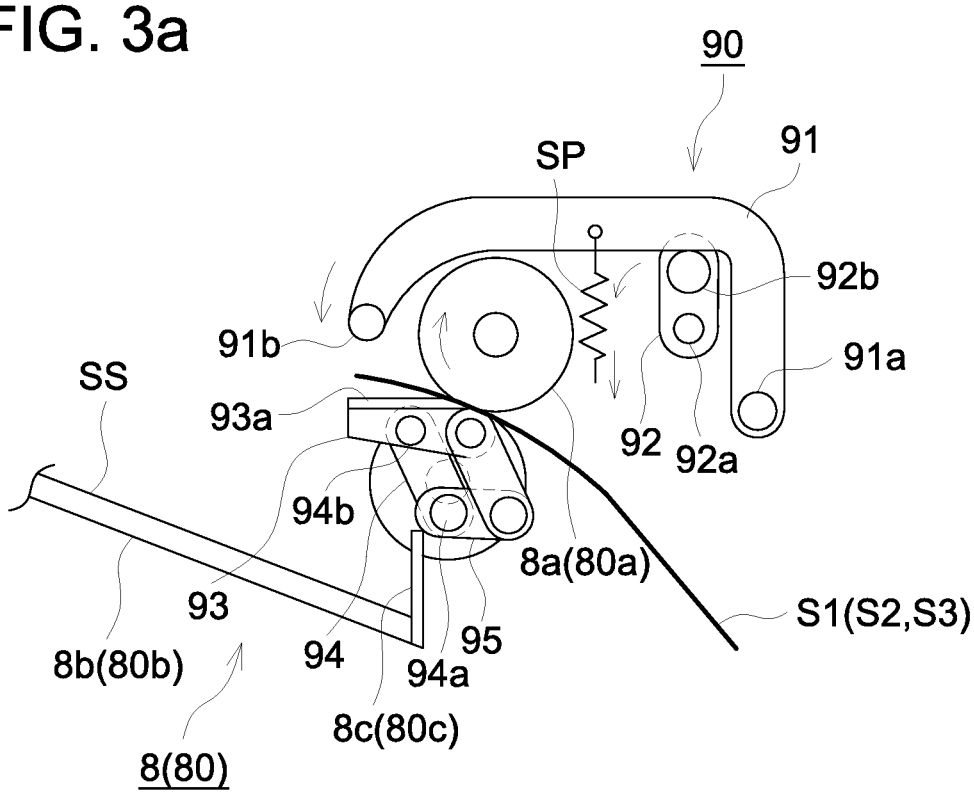
FIG. 3*a* is a cross-sectional configuration diagram explaining the configuration and the operation of an embodiment of a paper discharge apparatus 90 according to the present invention.
Figure 3B:
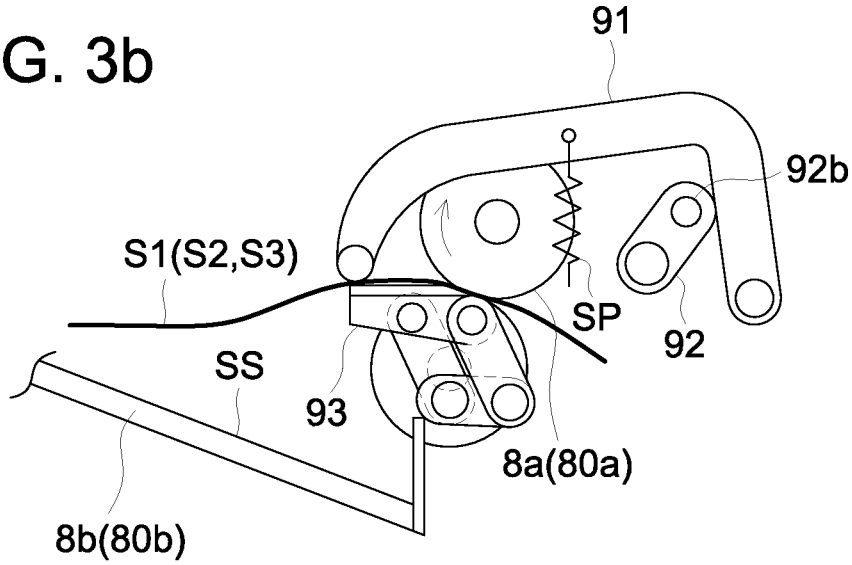
FIG. 3*b* is a cross-sectional configuration diagram explaining the configuration and the operation of an embodiment of a paper discharge apparatus 90 according to the present invention.
Figure 4A:
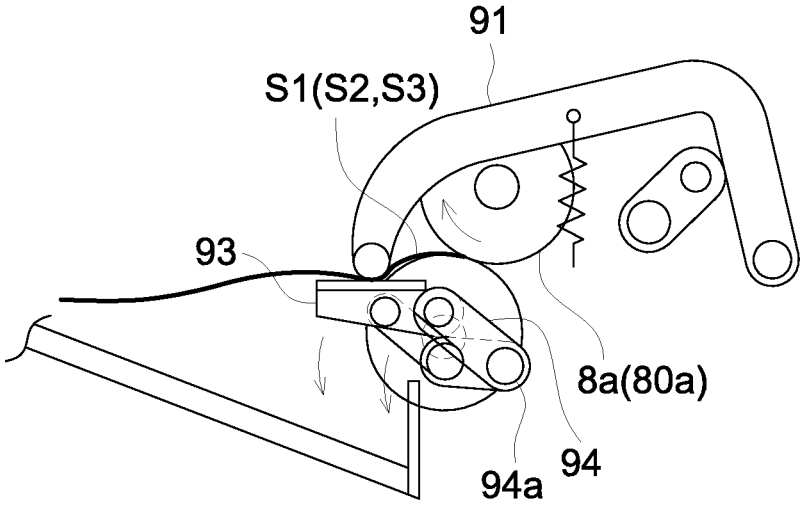
FIG. 4*a* is a cross-sectional configuration diagram explaining the operation of an embodiment of a paper discharge apparatus 90 according to the present invention.
Figure 4B:
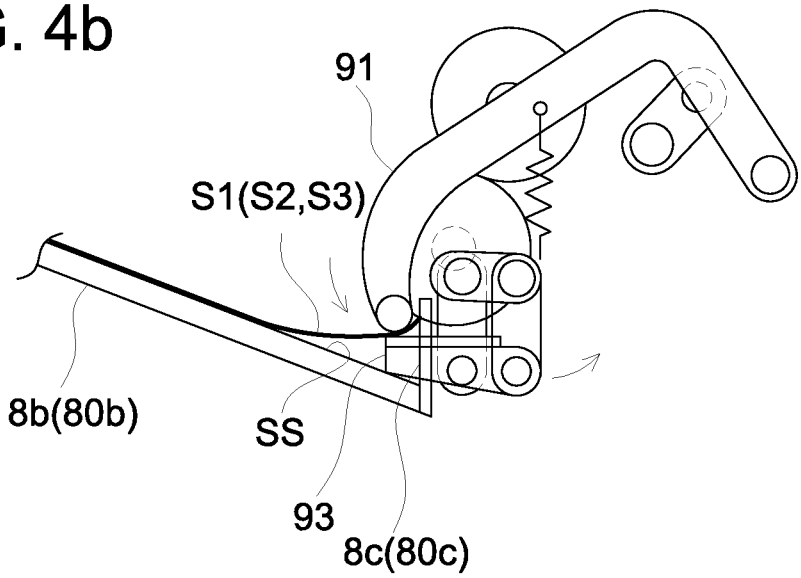
FIG. 4*b* is a cross-sectional configuration diagram explaining the operation of an embodiment of a paper discharge apparatus 90 according to the present invention.
Figure 5A:
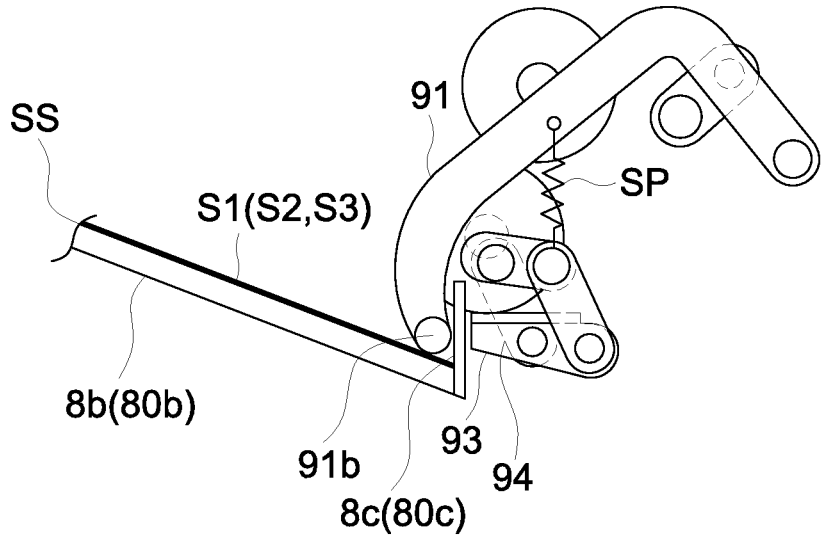
FIG. 5*a* is a cross-sectional configuration diagram explaining the operation of an embodiment of a paper discharge apparatus 90 according to the present invention.
Figure 5B:
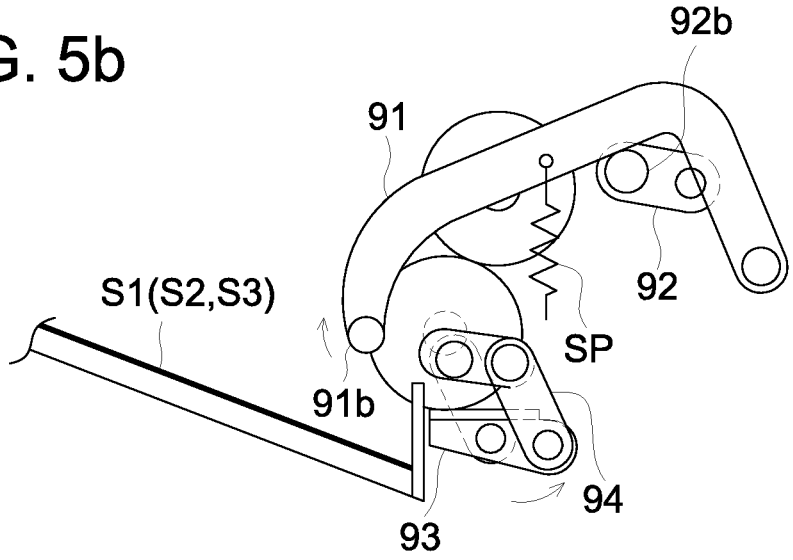
FIG. 5*b* is a cross-sectional configuration diagram explaining the operation of an embodiment of a paper discharge apparatus 90 according to the present invention.

FIG. 3*a* and FIG. 3*b* are cross-sectional configuration diagrams explaining the configuration and operation of an embodiment of a paper discharge apparatus 90 according to the present invention. FIG. 4*a*, FIG. 4*b*, FIG. 5*a*, and FIG. 5*b* are cross-sectional configuration diagrams explaining the operation of an embodiment of a paper discharge apparatus 90 according to the present invention. FIG. 3*a* and FIG. 3*b* illustrate the situation in which paper S1, S2, and S3 (hereinafter, representatively referred to as S1) is held by the paper discharge roller 8*a* or 80*a*; and FIG. 4*a* and FIG. 4*b* illustrate the situation in which paper S1 has passed through the paper discharge roller 8*a* or 80*a* and is carried while being held (pinched) by a pair of paper holding members (paper pinching member). Furthermore, FIG. 5*a* and FIG. 5*b* illustrate the situation after the paper S1 has been released from the pair of paper holding members and are loaded on the paper discharge tray 8*b* or the up-and-down paper discharge tray 80*b*.

As shown in FIG. 3*a* and FIG. 3*b* to FIG. 5*a* and FIG. 5*b*, a pair of paper holding members according to the present invention are composed of a paper pressing member 91 and a paper-receiving member 93.

The paper pressing member 91 is provided on one end with an engagement hole (no reference code assigned) for the engagement with the holding axis 91*a* for swingably holding the paper pressing member 91 and also provided on the other end with a pressing portion 91*b* for pressing via paper the paper-receiving member 93 functioning as the other paper holding member. Furthermore, a spring member SP functioning as a pressing member for pressing the paper-receiving member 93 is latched with the paper pressing member 91 functioning as the other paper holding member to apply a force so that the paper pressing member 91 can swing counter-clockwise. The paper pressing member 91 pressed by the spring member SP presses the paper-receiving member 93 while holding paper S1, follows the moving paper-receiving member 93, swings and moves.

The paper discharge mechanism portion 8 (or 80) is composed of a paper discharge roller 8*a* (or 80*a*) for discharging paper S1, a paper discharge tray 8*b* (or up-and-down paper discharge tray 80*b*) for loading the discharged paper S1, and a paper rear-end abutting portion 8*c* (or 80*c*) for abutting the rear end of the paper S1. Loading surface SS functioning as a paper loading portion for loading paper S1 is formed on the paper discharge tray 8*b* (or up-and-down paper discharge tray 80*b*). The paper position detection sensor PS, not shown, is disposed upstream of the paper discharge roller 8*a* (or 80*a*) in the paper conveying direction. In the embodiment, after the paper position detection sensor PS has detected the arrival of the paper S1, rotation speed of the paper discharge roller 8*a* (or 80*a*) is reduced in synchronized timing. Reducing the rotation speed of the paper discharge roller 8*a* (or 80*a*) ensures the reliability of the paper discharge operation of the paper discharge apparatus 90.

The pressing restriction device is composed of a pressure restriction member 92 for restricting the position of the paper pressing member 91 and a pressure restriction member drive motor M2 for driving the pressure restriction member 92. The pressure restriction member 92 is disposed adjacent to the paper pressing member 91. The pressure restriction member 92 is equipped with an axis portion 92*a* connected to the pressure restriction member drive motor M2, not shown, and rotatably holding the pressure restriction member 92, and the engagement portion 92*b* for engaging with the paper pressing member 91.

The paper-receiving member 93 is provided with a paper holding surface 93*a* (paper pinching surface) which the pressing portion 91*b* of the paper pressing member 91 abuts via paper, and also provided with a pair of holes (no reference code assigned) for rotatably engaging a pair of axes 94*b* fixed to one end of a pair of receiving member turning plates 94. A pair of rotation axes 94*a* are fixed to the other ends of the pair of receiving member turning plates 94, the pair of rotation axes 94*a* are rotatably held by the holding plate 95, and each rotation axis is connected to a paper-receiving member drive motor M3 functioning as a receiving member drive device so that the rotation can be executed at the same speed in the same direction and same timing. Therefore, the pair of receiving member turning plates 94 simultaneously rotate at the same speed in the same direction and same timing, turning the paper-receiving member 93; however, the paper holding surface 93*a* of the paper-receiving member 93 is designed to be always horizontal regardless of the rotation angle of the pair of receiving member turning plates 94. The paper-receiving member drive motor M3 rotates the pair of receiving member turning plates 94 once when the pair of paper holding members hold paper S1 once.

The paper holding member moving device according to the present invention is composed of a pair of receiving member turning plates 94, a pair of rotation axes 94*a* fixed to the pair of receiving member turning plates, a holding plate 95, and a paper-receiving member drive motor M3.

In this embodiment, the paper holding surface 93*a* is designed to be always horizontal; however, the paper holding surface 93*a* may have a certain angle to the horizontal plane.

Because the paper holding surface 93*a* of the paper-receiving member 93 according to the present invention is always horizontal or has a certain angle to the horizontal plane, a pair of paper holding members can stably and smoothly hold the paper S1.

Next, operation of the paper discharge apparatus 90 according to the present invention will be described.

FIG. 3*a* illustrates the situation in which paper S1 has reached the paper discharge roller 8*a* (or 80*a*) before the paper S1 reaches the paper holding position (paper pinching position). FIG. 3*b* illustrates the situation in which paper S1 is held by the paper pressing member 91 and the paper-receiving member 93 after the paper S1 has reached the paper holding position and before the rear end of the paper S1 reaches the paper holding position. Herein, the paper holding position means the position at which paper S1 and a pair of paper holding members are located at the moment when the paper S1 is held by the pair of paper holding members.

FIG. 4*a* illustrates the situation at the time when the rear end of paper S1 departs from the nipping portion of the paper discharge roller 8*a* (or 80*a*). FIG. 4*b* illustrates the situation in which paper S1 has reached the paper loading position and the rear end of the paper S1 abuts the paper rear-end abutting portion 8*c* (or 80*c*).

FIG. 5*a* illustrates the situation in which the paper-receiving member 93 has departed from the paper pressing member 91, and paper S1 is pressed by the paper pressing member 91 onto the loading surface SS of the paper discharge tray 8*b* (or up-and-down paper discharge tray 80*b*). FIG. 5*b* illustrates the process in which paper S1 has been loaded, and the pressure restriction member 92 operates to let the paper pressing member 91 depart from the paper S1.

In FIG. 3*a*, at the time when discharged paper S1 has reached the paper discharge roller 8*a* (or 80*a*) before the paper reaches the paper holding position (see FIG. 3*b*), the paper-receiving member 93 is located and stands by at the paper holding position where the paper-receiving member 93 holds the paper S1. On the other hand, the paper pressing member 91 is moved clockwise by the operation of the pressure restriction member 92 resisting against the pressure of the spring member SP and stands by at the retraction position distant from the paper-receiving member 93.

In FIG. 3*b*, when paper S1 reaches the paper holding position, the pressure restriction member 92 operates in synchronization with the timing for the paper position detection sensor PS, not shown, to detect paper S1, and the pressure restriction of the engaged paper pressing member 91 is released. When the pressure restriction has been released, the paper pressing member 91 is pressed by the spring member SP, thereby pressing the paper-receiving member 93 while holding the paper S1 at the paper holding position. This paper holding position is the position at which the rear end portion of the paper S1 has reached the position of the stand-by paper-receiving member 93 and the paper S1 is being held by a pair of paper holding members, and at this time, the paper S1 is in the process of being discharged while being held by the paper discharge roller 8*a* (or 80*a*).

With regard to the start of operation of the pressure restriction member 92, the pressure restriction member drive motor M2 operates in synchronization with the timing for the paper position detection sensor PS, not shown, to detect paper S1, and the rotation of the axis portion 92*a* coupled to the pressure restriction member drive motor M2 rotates the pressure restriction member 92.

During the period after paper S1 has been held at the paper holding position by the paper pressing member 91 and the paper-receiving member 93 and before the rear end of the paper S1 is discharged from the paper discharge roller 8*a* (or 80*a*), the paper S1 is carried by a conveyance force of the paper discharge roller 8*a* (or 80*a*). That is, the conveyed paper S1 slips between the paper pressing member 91 and the paper-receiving member 93.

Because paper does not drop by its own weight but is held by a pair of paper holding members according to the present invention and guided to the loading surface SS, it is possible to reduce the time to load the paper onto the loading surface SS and also ensure reliable loading. Furthermore, because paper S1 is being held while the paper S1 is carried to be discharged by the paper discharge roller 8*a* (or 80*a*), it is possible to reduce the time to load the paper onto the loading surface SS and also make the operation stable. Furthermore, because a pair of paper holding members hold the middle of the paper S1 and the paper pressing member 91 moves from a sufficiently distant location and holds the paper S1, the paper holding operation can be stable even if there is curling of the paper S1, ruffling of the operation, position deviation, or the like.

In FIG. 4*a*, when the rear end of paper S1 departs from the nipping portion of the paper discharge roller 8*a* (or 80*a*), the force for the paper discharge roller 8*a* (or 80*a*) to carry the paper S1 disappears, and the paper S1 moves according to the movement of the paper-receiving member 93 while the paper S1 is being pressed by the paper pressing member 91. Rotation of the paper-receiving member drive motor M3, not shown, rotates a pair of receiving member turning plates 94 via a pair of rotation axes 94*a* coupled to the paper-receiving member 93, thereby turning the paper-receiving member 93 counter-clockwise.

In FIG. 4*b*, when paper S1 has reached the paper loading position, the paper-receiving member 93 is moved from the paper pressing member 91 in the opposite direction of the paper conveying direction by the rotation of the paper-receiving member drive motor M3, and the rear end of the paper S1 abuts the paper rear-end abutting portion 8*c* (or 80*c*). Herein, the paper loading position means the positions of the paper S1 and a pair of paper holding members at the time when the bottom surface of the paper S1 contacts the loading surface SS of the paper discharge tray 8*b* (or up-and-down paper discharge tray 80*b*), and the rear end of the paper S1 abuts the paper rear-end abutting portion 8*c* (or 80*c*).

Because the paper-receiving member 93 according to the present invention is moved in the opposite direction of the paper conveying direction at the paper loading position, the rear end of paper S1 abuts the paper rear-end abutting portion 8*c* (or 80*c*), thereby making it possible to improve the paper aligning condition at the paper loading position.

In FIG. 5*a*, after the paper-receiving member 93 has departed, the paper pressing member 91 is pressed by the spring member SP, and the pressing portion 91*b* presses the paper S1 onto the loading surface SS of the paper discharge tray 8*b* (or up-and-down paper discharge tray 80*b*) while the rear end of the paper S1 abuts the paper rear-end abutting portion 8*c* (or 80*c*). In this condition, loading of the paper S1 onto the paper discharge tray 8*b* (or up-and-down paper discharge tray 80*b*) has been completed.

In FIG. 5*b*, rotation of the pressure restriction member drive motor M2 rotates the pressure restriction member 92 clockwise, the paper pressing member 91 swings clockwise resisting against the pressure of the spring member SP, and the pressing portion 91*b* of the paper pressing member 91 departs from the paper S1. After that, the paper pressing member 91 is returned to the retraction position, and the rotation of the paper-receiving member drive motor M3 rotates the pair of receiving member turning plates 94 counter-clockwise and returns the paper-receiving member 93 to the paper holding position; thus, the condition show in FIG. 3*a* is restored.

The paper pressing member 91 according to the present invention presses paper S1 onto the loading surface SS of the paper discharge tray 8*b* or the up-and-down paper discharge tray 80*b* at the paper loading position, thereby making it possible to improve the paper loading condition.

Figure 6:
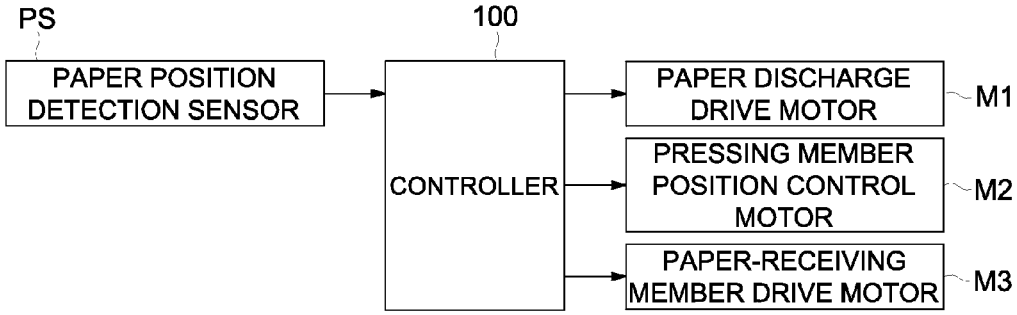
FIG. 6 is a block diagram explaining the flow of control of the controller 100 for controlling the operation of the paper discharge apparatus 90 according to the present invention.
Figure 7:
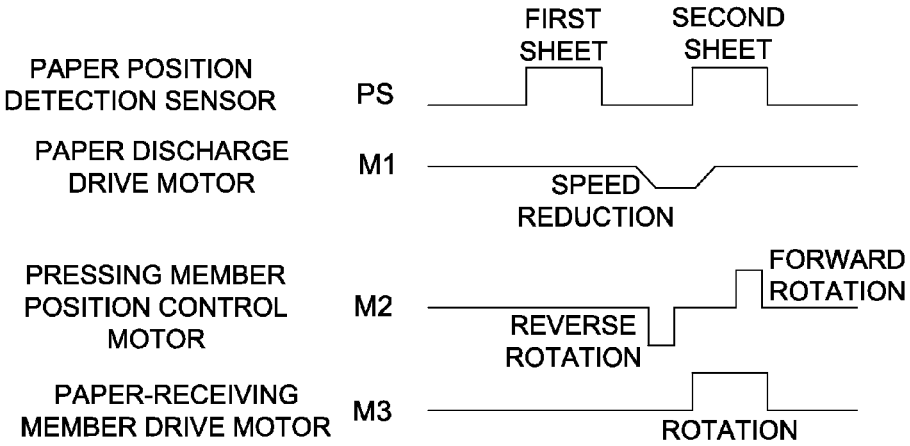
FIG. 7 is a timing diagram explaining the operation timing of the paper discharge apparatus 90 according to the present invention.

FIG. 6 is a block diagram explaining the flow of control of the controller 100 for controlling the operation of the paper discharge apparatus 90 according to the present invention. FIG. 7 is a timing diagram explaining the operation timing of the paper discharge apparatus 90 according to the present invention.

In FIG. 6, receiving the signal from the paper position detection sensor PS disposed upstream of the paper discharge roller 8*a* (or 80*a*) in the paper conveying direction, the controller 100 controls the rotation of the paper discharge roller 8*a* (or 80*a*) via the paper discharge drive motor M1. Hereinafter, at the timing adjusted by a timer, not shown, driving the pressure restriction member drive motor M2 and the paper-receiving member drive motor M3 will operate the pressure restriction member 92 and a pair of receiving member turning plates 94, thereby operating the paper pressing member 91 and the paper-receiving member 93.

In FIG. 7, turning on the print-start button, not shown, of the image forming apparatus main body B will rotationally drive the paper discharge drive motor M1, and after the first sheet of paper S1 has been detected by the paper position detection sensor PS, timing is adjusted by a timer, not shown, and the speed will be reduced. After the paper S1 has been detected by the paper position detection sensor PS, at an adjusted timing, the pressure restriction member drive motor M2 rotates in the opposite direction, thereby rotating the pressure restriction member 92 counter-clockwise, and the pressure restriction to the paper-receiving member 93 of the paper pressing member 91 is released. After that at an adjusted timing, the paper-receiving member drive motor M3 is driven, operating the paper-receiving member 93 via the member turning plate 94. Furthermore, in synchronization with the operation of the paper-receiving member 93, the pressure restriction member drive motor M2 rotates forward, rotating the pressure restriction member 92 clockwise, and then the paper pressing member 91 is returned to the retraction position. When the paper-receiving member 93 has returned to the paper holding position, the paper-receiving member drive motor M3 stops rotating.

In this embodiment, the paper discharge apparatus according to the present invention is disposed outside the image forming apparatus main body B or outside the post-processing device C; however, it is obvious that the paper discharge apparatus according to the present invention may be used as a temporary paper storing portion (intermediate stacker) disposed inside the image forming apparatus main body B or the post-processing device C.

The paper discharge apparatus 90 according to the present invention can apply not only to a sheet of paper, but also to plural bound or folded sheets of paper.

Furthermore, the present invention can effectively apply to the configuration wherein the paper discharge mechanism portion 80 has an alignment device for aligning paper in the direction (paper width direction) perpendicular to the paper conveying direction. That is, the use of the paper discharge apparatus 90 according to the present invention will reduce the time duration after paper S1 has departed from the paper discharge roller 8*a* (or 80*a*) and before the paper S1 is loaded onto the paper discharge tray 8*b* or the up-and-down paper discharge tray 80*b* as well as stabilize the operation; therefore, there is an advantage of gaining sufficient time to align the paper.

What is claimed is:

1. A paper discharge apparatus comprising:

a discharge device which conveys a paper in a paper conveying direction to discharge the paper;

a paper loading device having a paper loading portion and a paper rear-end abutting portion, wherein the paper loading portion loads the paper discharged by the discharge device, and the paper rear-end abutting portion abuts a rear end of the paper loaded on the paper loading portion as viewed in the paper conveying direction;

a paper pinching member which pinches the paper discharged by the discharge device at a paper pinching position to move the paper to a paper loading position on the paper loading portion of the paper loading device, wherein at the paper pinching position, the paper pinching member pinches the paper which is in a process of being discharged by the discharge device onto the paper loading portion of the paper loading device; and a moving device which moves the paper pinching member from the paper pinching position to the paper loading position so that the paper is moved from the paper pinching position to the paper loading position while being pinched by the paper pinching member;

wherein when the paper pinching member reaches the paper loading position, the moving device moves the paper pinching member in an opposite direction to the paper conveying direction so that the rear end of the paper pinched by the paper pinching member is abutted to the paper rear-end abutting portion of the paper loading device.

2. The paper discharge apparatus of claim 1, wherein the paper pinching member includes:

a paper receiving member;

a paper pressing member held pivotably; and a pressing member which presses the paper pressing member to the paper receiving member;

wherein before the paper which is in the process of being discharged by the discharge device reaches the paper pinching position, the paper receiving member stands by at the paper pinching position and the paper pressing member stands by at a retraction position distant from the paper pinching position;

wherein before the rear end of the paper as viewed in the paper conveying direction reaches the paper pinching position, the paper pressing member moves from the retraction position to the paper pinching position to pinch the rear end of the paper between the paper pressing member and the paper receiving member;

wherein the moving device moves the paper receiving member from the paper pinching position to the paper loading position, and then moves the paper receiving member in the opposite direction to the paper conveying direction; and wherein the paper pressing member moves with the paper receiving member while the paper is pinched between the paper receiving member and the paper pressing member.

3. The paper discharge apparatus of claim 2, wherein the moving device includes:

a pair of turning plates connected to the paper receiving member to rotate the paper receiving member;

a pair of rotation axes fixed to the pair of turning plates;

a holding plate which rotatably holds the pair of turning plates via the pair of rotation axes; and a drive device which rotates the pair of rotation axes in the same direction and at the same timing;

wherein the paper pinching member is moved between the paper pinching position and the paper loading position by the drive device which rotates the pair of turning plates via the pair of rotation axes;

wherein the paper receiving member has a paper pinching surface to pinch the paper between the paper receiving member and the paper pressing member; and wherein the paper pinching surface is kept to be horizontal or at a certain angle to a horizontal plane regardless of rotation angles of the pair of turning plates.

4. The paper discharge apparatus of claim 3, wherein the paper receiving member abuts the rear end of the paper as viewed in the paper conveying direction to the paper rear-end abutting portion of the paper loading device when the paper pinching member is moved to the paper loading position by a rotation of the pair of the turning plates, and thereafter the paper receiving member is released from the paper pressing member;

thereafter the paper pressing member presses the paper by a pressure of the pressing member onto a surface of the paper loading portion of the paper loading device; and thereafter the paper pressing member is returned to the retraction position; and the paper receiving member is returned to the paper pinching position.

5. The paper discharge apparatus of claim 2, further comprising a pressure restriction member which resists against a pressure of the pressing member in order to make the paper pressing member stand by at the retraction position.

6. The paper discharge apparatus of claim 5, wherein the pressure restriction member operates to allow the paper pressing member to move from the retraction position to the paper pinching position to pinch the paper, and the pressure restriction member operates to make the paper pressing member depart from the paper after loading the paper on the paper loading portion of the paper loading device.

7. An image forming apparatus comprising:

an image forming unit which forms an image on the paper; and the paper discharge apparatus of claim 1.

8. The image forming apparatus of claim 7, further comprising:

an image forming apparatus main body which includes the image forming unit that forms the image on the paper; and a post processing device which executes a post-processing operation on the paper discharged by the image forming apparatus main body.

* * * * *